United States Patent [19]

Manson

[11] Patent Number: 4,829,871

[45] Date of Patent: May 16, 1989

[54] WIRE FASTENING ARRANGEMENT

[76] Inventor: Hugh Manson, Dewsmoor Crediton, Devon, England

[21] Appl. No.: 195,900

[22] Filed: May 19, 1988

[30] Foreign Application Priority Data

May 20, 1987 [GB] United Kingdom ..... 8711865

[51] Int. Cl.[4] ..... G10D 3/10

[52] U.S. Cl. ..... 84/297 S; 84/199; 140/104

[58] Field of Search ..... 84/199, 297 S; 140/104

[56] References Cited

U.S. PATENT DOCUMENTS 443,809 12/1890 Albert ..... 84/199

4,581,976 4/1986 Ball ..... 84/297 S

*Primary Examiner*—Lawrence R. Franklin

*Attorney, Agent, or Firm*—Dowell & Dowell

[57] ABSTRACT

A guitar spring comprising an elongate first strand of wire (1) looped around an eyelet (2) to form a main length of wire and a shorter end piece (1[1]) wherein there is provided a shorter second strand (3) of wire looped around the eyelet (2) to form two limbs, the main length, end piece and two limbs being twisted together to unite the strands and secure the eyelet embraced by the strands.

2 Claims, 1 Drawing Sheet

WIRE FASTENING ARRANGEMENT

This invention concerns an improved wire fastening arrangement, for use in the attachment of a strand of wire to an appropriate anchorage.

In one known arrangement, which is utilised in the formation of an end attachment for a metallic guitar string, a single strand of wire forming the guitar string is looped around a thimble or eyelet, and the free end of the wire and the main part of the wire strand are twisted together to secure the thimble or eyelet within the loop.

Whilst such an arrangement is of simple construction, it has the disadvantage that it is vulnerable to breakage or slipping under the tension placed on the guitar string, particularly when the string is subjected to increased pressure during the operation of a tremolo.

In order to increase the strength of the above mentioned construction, it has been proposed to reinforce the twisted wire joint, for example by soldering of the wires, or the application of a binding to the twisted joint. However, this increases the complexity of the construction.

It is accordingly an object of the invention to provide an improved wire fastening that combines the advantage of simplicity with an increased resistance to breaking or slipping.

In accordance with the invention, this object is achieved in an arrangement of the kind initially referred to, in that there is incorporated in the twisted joint including the looped portion of said single strand of wire, at least one further strand of wire that is also looped around said thimble or eyelet, whereby an anchorage between the single strand of wire and the thimble or eyelet is effected by means of a twisted wire joint incorporating at least four strands.

Figure 1:
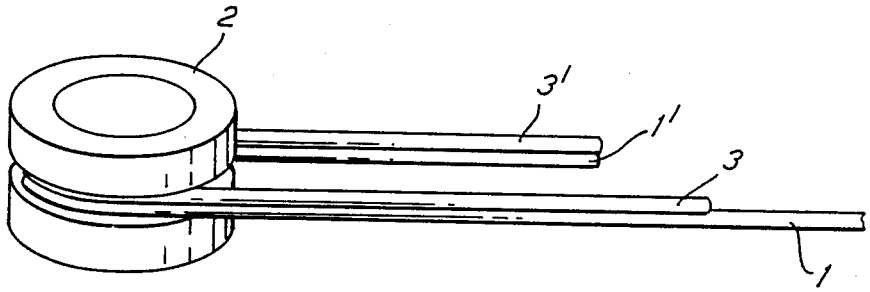
Figure 2:
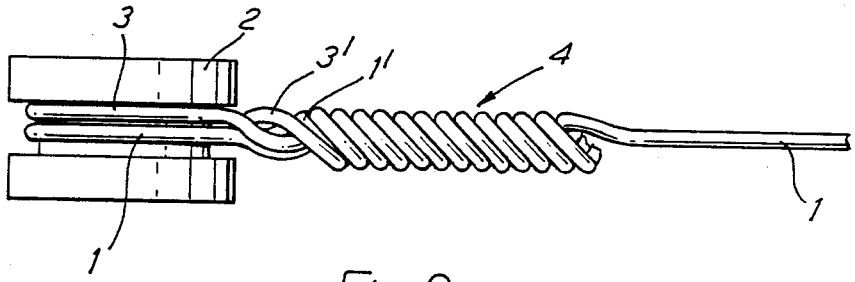

The invention is illustrated by way of example in the accompanying drawings, wherein:

FIG. 1 is a perspective view illustrating the component parts of a wire fastening prior to formation of a twisted joint, and FIG. 2 is an elevation of a completed joint formed from the components of FIG. 1.

Referring to the drawings, the reference numeral 1 designates a strand of wire, e.g. a guitar wire, that is to be secured to an eyelet or thimble 2, in order to provide a means for anchorage of the guitar wire to the bridge or tail-piece of the guitar, in known manner. A free end $1^1$ of the wire is looped around the eyelet 2. In the known arrangement, the wire 1 and the free end $1^1$ would simply be twisted together to secure the wire around the eyelet 2. However, in accordance with the invention, a second strand of wire 3 is also looped around the eyelet 2 so that an end $3^1$ thereof lies alongside the free end $1^1$ of the wire 1, as shown in FIG. 1. The four strands of wire formed by the two limbs of the looped wire 3 and the corresponding looped portion of the wire 1 are now twisted together as shown in FIG. 2, so that the twisted wire joint indicated at 4 incorporates four strands of wire wound together to unite the two loops of wire embracing the eyelet 2 and the single strand 1 forming the guitar wire.

The arrangement in accordance with the invention has been found to give a substantially improved resistance to breakage or slipping of the wire, despite the fact that the tension on the wound joint is still transmitted from the single strand 1. Moreover, despite the requirement for the presence of the second wire 3, the wound joint can be formed in a simple operation equivalent to that of the known arrangement.

Although the illustrated embodiment of the invention has been described in relation to the fastening of a guitar wire, it will be appreciated that the same principle can be applied to any similar arrangement where there is a replacement for the anchorage of a single strand of wire.

What is claimed is:

1. Wire fastening arrangement in which a strand of wire is looped around a thimble or eyelet and the free end of the wire and the main part of the wire strand are twisted together to secure the thimble or eyelet within the loop, wherein there is incorporated in the twisted joint including the looped portion of said single strand of wire, at least one further strand of wire that is also looped around said thimble or eyelet, whereby an anchorage between the single strand of wire and the thimble or eyelet is effected by means of a twisted wire joint incorporating at least four strands.

2. A guitar string comprising an elongate first strand of wire looped around an eyelet to form a main length of wire and a shorter end piece, wherein there is provided a shorter second strand of wire looped around the eyelet to form two limbs, the main length, end piece and two limbs being twisted together to unite the strands and secure the eyelet embraced by the strands.

* * * * *